US008162109B2

(12) United States Patent
Amano

(10) Patent No.: US 8,162,109 B2
(45) Date of Patent: Apr. 24, 2012

(54) ELEVATOR SYSTEM WHICH LIMITS THE NUMBER OF DESTINATION CALL REGISTRATIONS TO BE ALLOCATED TO THE SINGLE CAR

(75) Inventor: Masaaki Amano, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 397 days.

(21) Appl. No.: 12/518,655

(22) PCT Filed: Mar. 29, 2007

(86) PCT No.: PCT/JP2007/056814

§ 371 (c)(1),
(2), (4) Date: Jun. 11, 2009

(87) PCT Pub. No.: WO2008/120345

PCT Pub. Date: Oct. 9, 2008

(65) Prior Publication Data

US 2010/0025163 A1 Feb. 4, 2010

(51) Int. Cl.
*B66B 1/18* (2006.01)

(52) U.S. Cl. ..... 187/382; 187/391

(58) Field of Classification Search ..... 187/247, 187/380–389, 391–393
See application file for complete search history.

(56) References Cited

U.S. PATENT DOCUMENTS

| | | | | |
|---|---|---|---|---|
| 3,973,649 | A * | 8/1976 | Iwasaka et al. | 187/387 |
| 3,999,631 | A * | 12/1976 | Iwasaka et al. | 187/387 |
| 4,915,197 | A | 4/1990 | Schroder | |
| 5,252,790 | A * | 10/1993 | Aime | 187/387 |
| 5,663,538 | A * | 9/1997 | Sakita | 187/382 |
| 6,237,721 | B1 * | 5/2001 | Siikonen | 187/382 |
| 6,401,874 | B2 * | 6/2002 | Siikonen | 187/382 |
| 7,083,027 | B2 * | 8/2006 | Siikonen et al. | 187/383 |
| 7,416,057 | B2 * | 8/2008 | Kostka | 187/382 |
| 2010/0300814 | A1 * | 12/2010 | Eto et al. | 187/247 |

FOREIGN PATENT DOCUMENTS

| | | |
|---|---|---|
| JP | 64 11548 | 2/1989 |
| JP | H06-092555 | 4/1994 |
| JP | 7 232867 | 9/1995 |
| JP | 2563545 | 12/1996 |
| JP | 2003 341946 | 12/2003 |
| JP | 2006 8368 | 1/2006 |

OTHER PUBLICATIONS

Office Action issued Jan. 17, 2012 in Japanese Patent Application No. 2009-507337 (with English Translation).

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In an elevator system, a group supervisory control apparatus selects a car responding to a destination call registration performed on a landing destination operating panel. A limit value of the number of destination call registrations for stop floors existing in the same direction from the same stop floor is set in the group supervisory control apparatus in a manner corresponding to the stop floor. The group supervisory control apparatus counts the number of destination call registrations for the stop floors existing in the same direction from the same stop floor in response to the destination call registration performed on the landing destination operating panel, and limits the number of destination call registrations to be allocated to the single car according to a limit value corresponding to the stop floor.

4 Claims, 3 Drawing Sheets

ELEVATOR SYSTEM WHICH LIMITS THE NUMBER OF DESTINATION CALL REGISTRATIONS TO BE ALLOCATED TO THE SINGLE CAR

TECHNICAL FIELD

The present invention relates to an elevator system which controls the travel of a plurality of cars with a group supervisory control apparatus and includes landing destination operating panels, each for enabling a destination call registration, provided on a plurality of stop floors.

BACKGROUND ART

In a conventional elevator control apparatus, stop floors are divided into a plurality of destination zones, each including a plurality of continuous floors. In response to destination information from an information input apparatus provided to a landing, a car to be allocated is determined for each destination zone. In addition, any of the number of destination zones, the contents of allocation of the stop floors to each of the destination zones, and the contents of allocation of the car to each of the destination zones is changed based on the destination information (for example, see JP 2003-341946 A).

DISCLOSURE OF THE INVENTION

Problem to be Solved by the Invention

In the conventional elevator control apparatus as described above, for example, when destination calls for three discontinuous destination floors are registered on a main floor, the three destination floors may be included in different destination zones in some cases. In such a case, three cars are dispatched to the main floor. Specifically, with the conventional elevator control apparatus, the number of cars larger than needed are dispatched even during off-peakhours other than peakhours, resulting in lowered travel efficiency.

The present invention is devised to solve the problem described above, and has an object of obtaining an elevator system capable of improving the travel efficiency of cars.

Means for Solving the Problems

An elevator system according to the present invention includes: a plurality of cars; a plurality of landing destination operating panels provided to landings on a plurality of stop floors, each of the landing destination operating panels being for enabling a destination call registration; and a group supervisory control apparatus for selecting the car responding to the destination call registration performed on the landing destination operating panel, in which a limit value of the number of destination call registrations for the stop floors existing in the same direction from the same stop floor is set in the group supervisory control apparatus in a manner corresponding to the stop floor, and the group supervisory control apparatus counts the number of destination call registrations for the stop floors existing in the same direction from the same stop floor in response to the destination call registration performed on the landing destination operating panel and limits the number of destination call registrations to be allocated to the single car according to the limit value corresponding to the stop floor.

BEST MODE FOR CARRYING OUT THE INVENTION

Figure 1:
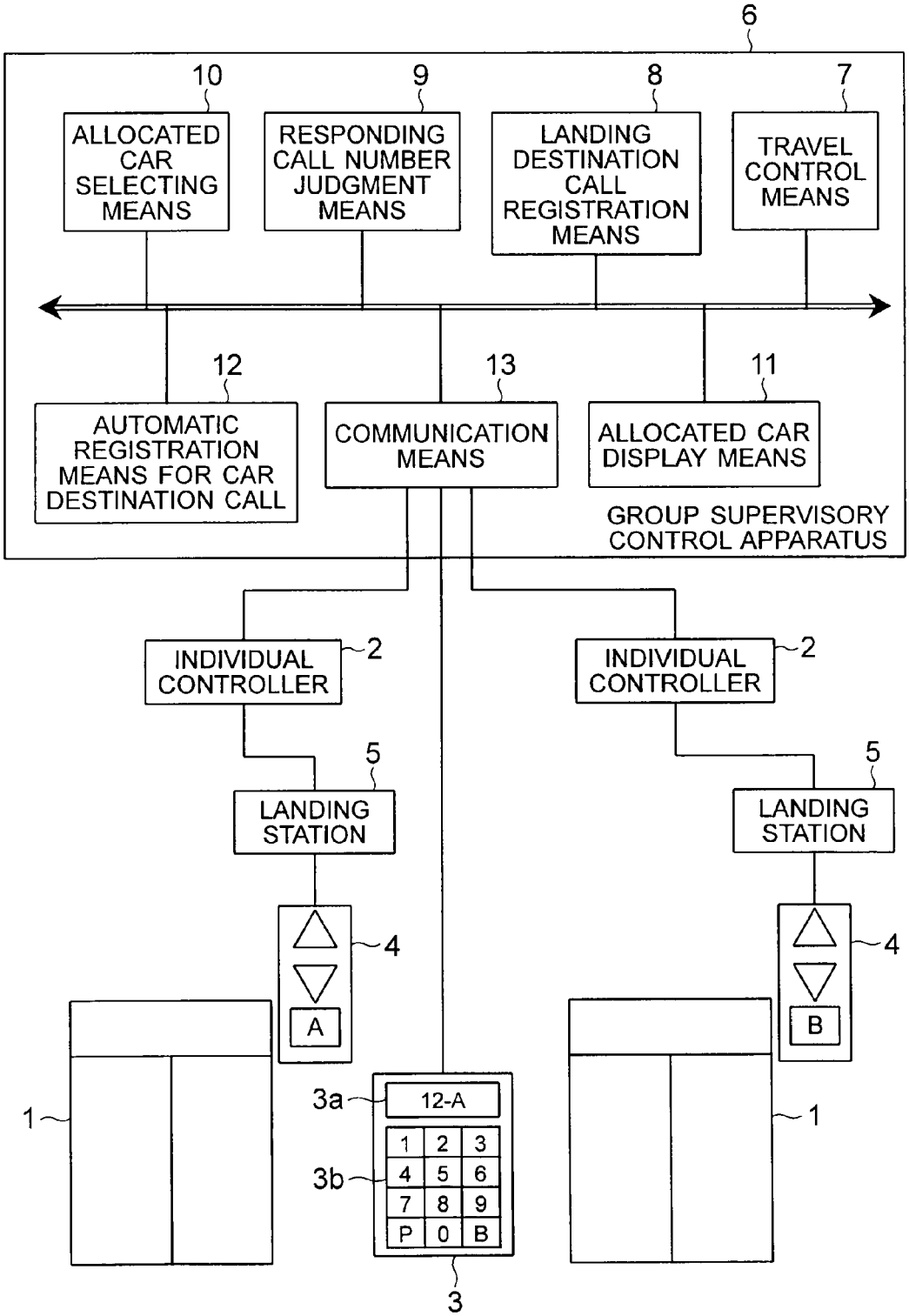
FIG. 1 is a configuration diagram illustrating a principal part of an elevator system according to a first embodiment of the present invention.

Hereinafter, a preferred embodiment of the present invention is described referring to the drawings.

First Embodiment

FIG. 1 is a configuration diagram illustrating a principal part of an elevator system according to a first embodiment of the present invention. In the drawing, a plurality of elevator apparatuses are provided in a building. An operation of a car 1 of each of the elevator apparatuses is controlled by a corresponding individual controller 2. In this example, two elevator apparatuses, i.e., cars A and B are provided.

Landing destination operating panels 3 (only one thereof is illustrated in FIG. 1) for enabling a destination call registration are provided to the respective landings of a plurality of stop floors (elevator stop floors). The landing destination operating panels 3 may be provided only on specific floors corresponding to relatively crowded floors, or may be provided on all the stop floors. The landing destination operating panel 3 includes a display portion 3*a* and a numeric keyboard portion 3*b* for inputting a floor number.

A plurality of hall lanterns 4 are provided on each of the stop floors. Each of the hall lanterns 4 displays the predicted arrival or the arrival of the car 1. Moreover, a car indication lamp for displaying a car name when a destination call is allocated to the car is also provided to the hall lantern 4.

Each of the hall lanterns 4 is connected to the individual controller 2 through a landing station 5. The landing station 5 is provided to the landing to perform communication between devices (including the hall lantern 4) provided to the landing and the individual controller 2.

The individual controllers 2 and the landing destination operating panels 3 are connected to a group supervisory control apparatus 6. The group supervisory control apparatus 6 is provided in a machine room to control the elevator apparatuses as a group. The group supervisory control apparatus 6 also selects the car 1 responding to the destination call registration performed on the landing destination operating panel 3.

For the group supervisory control apparatus 6, a limit value of the number of destination call registrations for the stop floors existing in the same direction from the same stop floor is set in a manner corresponding to the stop floor. Then, the group supervisory control apparatus 6 counts the number of destination call registrations for the stop floors existing in the same direction from the same stop floor in response to the destination call registration performed on the landing destination operating panel 3, and in addition, limits the number of destination call registrations allocated to the single car 1 according to the limit value corresponding to the stop floor.

More specifically, the stop floors, on which the landing destination operating panels 3 are provided, are registered in the group supervisory control device 6 in such a manner that the stop floors are classified into general floors and crowded floors which are expected to be more crowded than the general floors. A limit value for the crowded floors is set smaller than that for the general floors.

The group supervisory control apparatus 6 includes travel control means 7, landing destination call registration means 8, responding call number judgment means 9, allocated car selecting means 10, allocated car display means 11, automatic registration means 12 for car destination call, and communication means 13.

The travel control means 7 controls the travel of all the elevator apparatuses. The landing destination call registration means 8 registers a destination call corresponding to a pressed destination button. The responding call number judgment means 9 counts the number of destination call registrations for the stop floors existing in the same direction from the same stop floor in response to the destination call registration performed on the landing destination operating panel 3 and, in addition, judges whether the floor, on which the operated landing destination operating panel 3 is provided, is the general floor or the crowded floor.

The allocated car selecting means 10 selects the car responding to the registered destination call. The allocated car display means 11 displays the name of the allocated car on the landing destination operating panel 3. The automatic registration means 12 for car destination call automatically registers the destination call in the car 1. The communication means 13 performs serial communication with the individual controller 2.

The functions of the travel control means 7, the landing destination call registration means 8, the responding call number judgment means 9, the allocated car selecting means 10, the allocated car display means 11, the automatic registration means 12 for car destination call and the control means 13 can be realized by a microcomputer. Specifically, a program (software) for realizing the functions of the group supervisory control apparatus 6 is stored in a storage section of the microcomputer.

Figure 2:
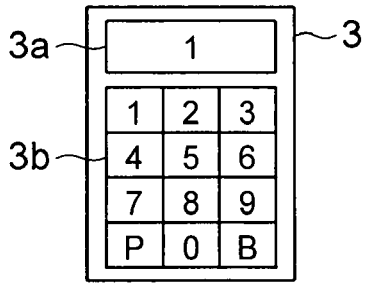
FIG. 2 is a front view illustrating a display state in the case where one figure is input to a landing destination operating panel illustrated in FIG. 1.
Figure 3:
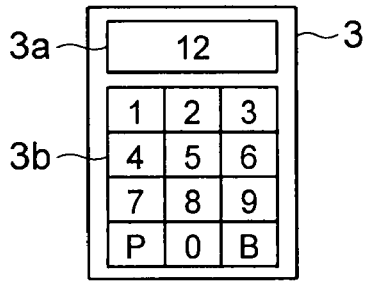
FIG. 3 is a front view illustrating the display state in the case where two figures are sequentially input to the landing destination operating panel illustrated in FIG. 1.
Figure 4:
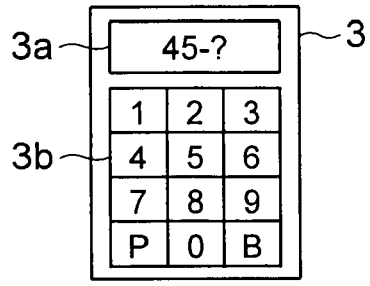
FIG. 4 is a front view illustrating the display state in the case where a number corresponding to a nonexistent stop floor is input to the landing destination operating panel illustrated in FIG. 1.

FIGS. 2 to 4 are front views, each illustrating a change in the contents of display on the landing destination operating panel 3 illustrated in FIG. 1. For example, when a destination call for the twelfth floor is to be registered, a figure "1" is first entered on the numeric keyboard portion 3*b*. As a result, on the display portion 3*a*, a number "1" is displayed as illustrated in FIG. 2. Subsequently, when a figure "2" is entered on the numeric keyboard portion 3*b*, a number "12" is displayed as illustrated in FIG. 3, thereby completing the input for the twelfth floor.

Upon completion of the input for the destination floor, computation for allocation of the call is executed in the group supervisory control apparatus 6. When the car to be allocated is determined, the name of the car to be allocated is displayed as illustrated in FIG. 1. The character and numerals "12-A" displayed on the display section 3*a* illustrated in FIG. 1 mean "the user for the twelfth floor is invited to get on the car A". After elapse of a predetermined period of time from the display, light of the display portion 3*a* is switched off (with no display) and the display portion 3*a* is brought into a standby state until the operation is performed by a next user.

When a stop floor which does not exist in a bank corresponding to the group supervisory control apparatus 6 is input, the numerals and symbol "45-?" are displayed, as illustrated in FIG. 4. This display means "the destination call for the forty-fifth floor has not been successfully registered".

Figure 5:
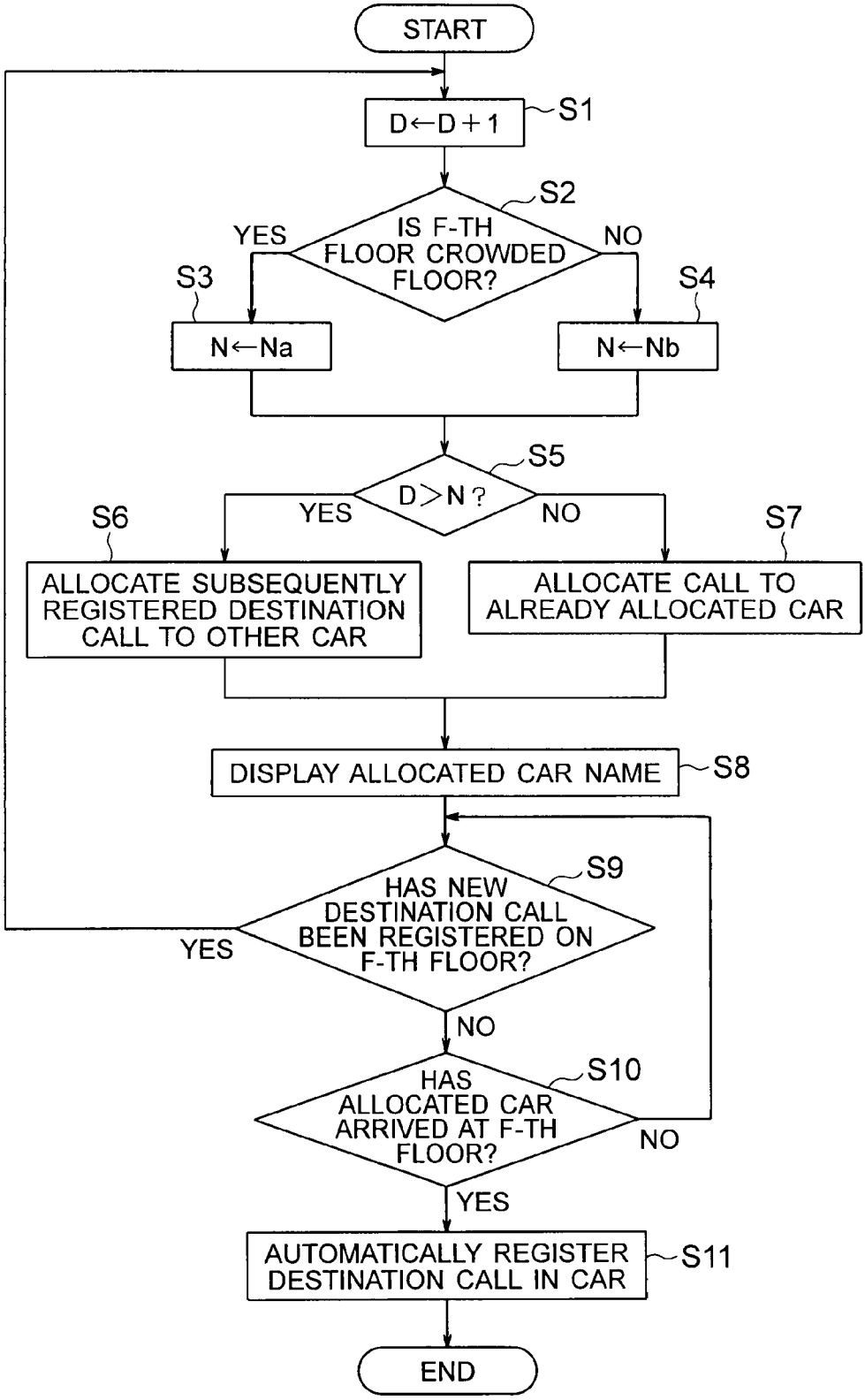
FIG. 5 is a flowchart illustrating an operation of a group supervisory control apparatus 6 in response to a destination call registration performed on the landing destination operating panel illustrated in FIG. 1.

FIG. 5 is a flowchart illustrating an operation of the group supervisory control apparatus 6 in response to the destination call registration performed on the landing destination operating panel 3 illustrated in FIG. 1. For example, when a destination call for the F-th floor is registered on the landing destination operating panel 3, the number D of registered destination call registrations for the stop floors existing in the same direction from the F-th floor is counted up (Step S1). Then, it is judged whether or not the F-th floor is the crowded floor (Step S2).

If the F-th floor is the crowded floor, a limit value N of the number of destination call registrations for the single car 1 is set to Na (Step S3). On the other hand, if the F-th floor is the general floor, the limit value N of the number of destination call registrations for the single car 1 is set to Nb (Step S4). Then, it is judged whether or not the number of registered destination call registrations D for the floor existing in the same direction from the F-th floor is larger than the limit value N (Step S5).

When a relation: $D>N$ is established, the subsequently registered destination calls including the currently registered destination call are allocated to other car(s) 1 (Step S6). On the other hand, when a relation: $D \leqq N$ is established, the currently registered destination call is allocated to the already allocated car 1 (Step S7). Then, the name of the allocated car is displayed on the display section 3*a* of the landing destination operating panel 3 (Step S8).

Next, it is verified whether or not a new destination call for the floor existing in the same direction from the F-th floor has been registered (Step S9). When the new destination call is registered, the processing returns to the step of counting up the number D of destination call registrations (Step S1).

If the new destination call has not been registered, it is judged whether or not the car 1 allocated to the F-th floor has arrived at the F-th floor (Step S10). If the car 1 has not arrived at the F-th floor yet, monitoring for the new destination call and monitoring for the arrival of the car 1 at the F-th floor are continued. Then, upon arrival of the car 1 at the F-th floor, the destination call is automatically registered in the arriving car 1 (Step S11) and the processing is terminated.

In the elevator system as described above, the number of destination call registrations for the stop floors existing in the same direction from the same stop floor is counted in response to the destination call registration performed on the landing destination operating panel 3, while the number of destination call registrations to be allocated to the single car 1 is limited according to the limit value corresponding to the stop floor. Therefore, the car 1 can be efficiently dispatched according to a status of use of the building. As a result, the travel efficiency as the entire system can be improved.

Moreover, the stop floors, on which the landing destination operating panels 3 are provided, are registered in the group supervisory control apparatus 6 in such a manner that the stop floors 6 are classified into the general floors and the crowded floors. The limit value for the crowded floors is set smaller than that for the general floors ($Na<Nb$). Therefore, the number of destination call registrations to be allocated to the single car 1 is kept small for the crowded floors. As a result, a round trip time of the car 1 can be reduced to improve transport efficiency. For the general floors, the number of destination call registrations as large as possible can be allocated to the single car 1. As a result, a waiting time for the elevators in the whole building can be reduced.

The control for varying the limit value depending on the stop floors may be carried out only during busy hours such as morning and evening commuting times and a lunchtime, or may be carried out throughout the day.

Furthermore, the landing destination operating panels may be provided on all the stop floors, or may be provided on a part of the stop floors. In the case where the landing destination operating panel are provided on all the stop floors, it is also possible to omit a destination button which is otherwise provided in the car 1.

Furthermore, although two limit values of the number of destination call registrations for the stop floors existing in the same direction are respectively set for the general floors and for the crowded floors, three or more limit values may be set for the respective categories.

The invention claimed is:

1. An elevator system comprising:

a plurality of cars;

a plurality of landing destination operating panels provided to landings on a plurality of stop floors, each of the landing destination operating panels being for enabling a destination call registration; and a group supervisory control apparatus for selecting the car responding to the destination call registration performed on the landing destination operating panel, wherein a limit value of the number of destination call registrations for the stop floors existing in the same direction from the same stop floor is set in the group supervisory control apparatus for each of the stop floors, and the group supervisory control apparatus counts the number of destination call registrations for the stop floors existing in the same direction from the same stop floor in response to a destination call registration performed on the landing destination operating panel of the same stop floor, and limits the number of destination call registrations to be allocated to a single car according to the limit value corresponding to the stop floor.

2. The elevator system according to claim 1, wherein the stop floors, on which the landing destination operating panels are provided, are registered in the group supervisory control apparatus in such a manner that the stop floors are classified into a general floor and a crowded floor expected to be more crowded than the general floor, and the limit value for the crowded floor is set smaller than that for the general floor.

3. An elevator system comprising:

a plurality of cars;

a plurality of landing destination operating panels provided to landings on a plurality of stop floors, each of the landing destination operating panels being for enabling a destination call registration; and a group supervisory control apparatus for selecting the car responding to the destination call registration performed on the landing destination operating panel, wherein the group supervisory control apparatus comprises:

means for setting a limit value, for each of the stop floors, of the number of destination call registrations for the stop floors existing in the same direction from the same stop floor, wherein the means for setting a limit value comprises means for counting the number of destination call registrations for the stop floors existing in the same direction from the same stop floor in response to a destination call registration performed on the landing destination operating panel of the same stop floor, and means for limiting the number of destination call registrations to be allocated to a single car according to the limit value corresponding to the stop floor.

4. The elevator system according to claim 1, wherein the group supervisory control apparatus further comprises means for classifying the stop floors into a general floor and a crowded floor expected to be more crowded than the general floor, wherein the limit value for the crowded floor is set smaller than that for the general floor.

* * * * *